US005771517A

United States Patent [19]

Neveu et al.

[11] Patent Number: 5,771,517

[45] Date of Patent: Jun. 30, 1998

[54] PROCESS FOR PROCESSING A CELLULOSE FIBER LAP

[75] Inventors: Jean-Louis Neveu, Lery; Bernard Louis Dit Picard, Amfreville-la-Champagne, both of France

[73] Assignee: Fort James France, Kunheim, France

[21] Appl. No.: 875,596

[22] PCT Filed: Feb. 2, 1996

[86] PCT No.: PCT/FR96/00181

§ 371 Date: Sep. 2, 1997

§ 102(e) Date: Sep. 2, 1997

[87] PCT Pub. No.: WO96/23922

PCT Pub. Date: Aug. 8, 1996

[30] Foreign Application Priority Data

Feb. 3, 1995 [FR] France ..... 95 01280

[51] Int. Cl.[6] ..... D06B 11/01

[52] U.S. Cl. ..... 8/151

[58] Field of Search ..... 8/151, 147, 151.1, 8/158; 28/103, 104, 105, 165, 167, 169

[56] References Cited

U.S. PATENT DOCUMENTS 3,864,079 2/1975 Gregg ..... 8/151

4,132,524 1/1979 Hasselschwert ..... 8/151

5,253,397 10/1993 Neven et al. ..... 28/105

FOREIGN PATENT DOCUMENTS 2054010 4/1971 France ..... 8/151

2660942 10/1991 France ..... 8/151

*Primary Examiner*—C. D. Crowder

*Assistant Examiner*—Larry D. Worrell, Jr.

*Attorney, Agent, or Firm*—Breiner & Breiner

[57] ABSTRACT

A process for treating natural cellulose fibers, in particular cotton fibers, comprising the stages of depositing the fibers on a continuously moving wire to form a lap evincing a specific surface weight of 100 to 800 g/m$^2$, impregnation with a treating solution, treatment, and rinsing using an aqueous liquid, characterized in that rinsing is carried out by applying the liquid in the form of jets directed at one side of the lap perpendicularly to its direction of advance at an energy between 2 and 60 kwh/ton of treated product. The rinsing station (100) comprises at least one needle injector (105, 115) situated across the lap and applying highly pressurized water jets to its surface. The liquid is sucked in through a transverse slot communicating with a suction box (110, 125).

9 Claims, 3 Drawing Sheets

THICKNESS, mm
5
4.5
4
3.5
3
2.5
2
0
2.2
4.4
9.8
15.2
20.4
25.8
32.8
40
48.4
56.8
ENERGY Kwh/TON

SH %mm
0.9
0.8
0.7
0.6
0.5
0.4
0.3
0.2
0.1
0
H
S
0
8.9
18.6
21.9
25.3
28.5
32
34.4
36.9
39.1
41.3
m³ WATER/TON OF COTTON

STRENGTH, N
50
45
40
35
30
25
20
15
10
5
0
0
2.2
4.4
9.8
15.2
20.4
25.8
32.8
40
48.4
56.8
ENERGY Kwh/TON

PROCESS FOR PROCESSING A CELLULOSE FIBER LAP

The invention concerns a process for treating a natural fiber lap, for example a cotton fiber lap, and in particular the stage during which the fibers are rinsed to eliminate the chemical products that impregnated the lap before the treatment.

Illustratively, when preparing absorbent cotton from crude cotton, the leaves, twigs or other foreign materials acquired in cotton picking are first eliminated. Next, the sheaths of waxy and fatty materials of the fibers are stripped by a chemical boiling-off treatment consisting in impregnating a lap formed by the crude fibers, for example with a soda-based liquor which is made to react while heated in evaporating equipment. Following treatment, the lap is neutralized and then rinsed with water. Depending on need, the fibers will be bleached and/or oiled. In bleaching, the fibers are made to contact an aqueous oxygenated solution that is allowed to react at an appropriate temperature before the fibers are neutralized and then rinsed again with water.

Boiling-off and bleaching may be carried out batch-wise in liquor-containing tubs. However, recently continuous treatment processes have been developed in order to lower costs when absorbent cotton is manufactured on a large scale. In this field, applicant developed a continuous process allowing the making of a lap offering a given cohesion and which can be used in some applications, such as for packed surgical cotton, dressings or cosmetic pads, without needing to rework the lap mechanically, that is to shred it in order to card it or to form a lap in some other manner.

Such a process is described in French Patent Application No. 90 04647.

In the process, the impregnation stages by the various liquors for boiling-off, bleaching or neutralization rinsing are carried out by pouring liquid sheets on the lap under such conditions as to control the amount of liquid carried away by the sheet and simultaneously to achieve its homogeneous impregnation. Overall process efficiency is improved thereby, also the material quality following treatment of the features vary little from one production run to the next. Applying liquid in such a manner assures firming of the lap because of the energy of the liquid transferred to it.

Attempts have been made to further improve this process, in particular rinsing efficacy, because large quantities of water are required to eliminate the chemical products, in particular the surfactants needed during the initial impregnation phase of the crude cotton. Rinsing before the final finishing or prior to drying is especially significant in that regard because of the desirability of minimizing as much as possible the proportion of residual products, in particular in the light of the Codex. Moreover, considering the ever present desire to maintain and, if possible, to improve product quality without incurring higher costs, rinsing must not degrade the lap's mechanical properties during treatment. This condition only applies where it is desired to use the lap, after it was dried without having to work on it again, in such conventional uses as absorbent cotton or makeup removal pads.

The invention provides a process for treating natural cellulose fibers, in particular cotton fibers, comprising the stages of depositing fibers on a permeable conveyor wire to form a lap having a specific surface weight of 100 to 800 g/m$^2$, impregnating with a treatment liquor, and treatment then of rinsing using an aqueous liquid, being characterized in that rinsing is carried out by applying the liquid in the form of jets directed at one side of the lap perpendicularly to its direction of advance and imparting to the lap an energy between 2 and 100 kwh/ton of treated product.

The jets are created by injectors such as used in hydrodynamic binding of non-wovens, each injector illustratively comprising an elongated chamber closed lengthwise by a perforated plate with one or more rows of many small-diameter (about 100 $\mu$m) orifices. The chamber is fed with pressurized liquid issuing from the orifices in the form of fine, parallel jets of corresponding diameters. In one embodiment of the invention, a double-row injector having 120 $\mu$m diameter orifices which are spaced from one another by 0.6mm apply an energy of 2 to 58 kwh/ton and spread an amount of rinsing water respectively of 9 to 41 m$^3$/ton of treated product. Such energies correspond to effective injector pressures between 5 and 50 bars.

In the present invention, the jets are used to rinse a lap which can have a specific surface weight as high as 800 g/m$^2$, well beyond the specific surface weights of the non-wovens for which they are meant.

The magnitude of the energy to be supplied depends on the thickness and the specific surface weight of the lap. Preferably, the energy imparted to the lap should be less than 40 kwh/ton. This should be the case, for example, for a lap of 250 g/m$^2$.

Surprisingly, it was found that this process offers several advantages:

- rinsing efficiency is significantly improved relative to rinsing by pouring a liquid; for every low energy levels, namely at 2.2 kwh/ton, the foam height vanishes and the proportion of soluble solutions drops by 30 to 50%; these two parameters reflecting the residual quantity of treatment chemicals;
- where a simple treatment for a fiber lap is concerned, with the purpose of forming a firmed lap to be used directly as a packaged absorbent cotton or as a dressing, absorbing pad or makeup removal pad in the absence of processing other than cutting and conditioning, it is important that the lap thickness is significantly retained in this rinsing method; surprisingly, within the above-defined energy range, the thickness of the process output product after the drying stage remains substantially constant and corresponds to that evinced in the procedure using liquid-sheet rinsing;
- in spite of the low energy of the jets, the lap strength is enhanced in some respects, in particular, the jet treatment produces lap strengthening in the surface layers without thereby affecting the layers underneath; this process is especially advantageous for stratified laps comprising an aerodynamically formed central lap between two card webs as described in French Patent Application No. 93 00928.

In another feature of the invention, the liquid flow is between 8 and 40 m$^3$/ton of cotton.

In particular, this flow is limited to 8 m$^3$/ton, corresponding to low energy levels less than 10 kwh/ton, in particular as regards cotton laps for packaged absorbent cotton. This flow allows ready rinsing of the lap effectively and in such a case an increase in lap mechanical strength is not sought.

As regards makeup removal pads, for example, applying an energy of 4 to 30 kwh/ton allows increasing strength without making the lap thinner.

In another feature of the invention, the jets also are applied to the side opposite the first one. In this manner, the surface condition of the product will be the same on both sides and the product is symmetric.

In yet another feature of the invention, up to 30% of synthetic or artificial fibers are incorporated into the lap.

Advantageously these fibers are admixed with the cellulose fibers before treatment begins. They may be any known fibers in the field of woven and nonwoven textiles.

Other features and advantages are elucidated in the following description of an illustrative and non-limiting embodiment of the invention in relation to the drawings.

FIG. 1 schematically shows apparatus of the prior art for continuously boiling-off and bleaching fibers.

FIG. 1*a* is a detail of the rinsing station of the invention.

Figure 1:
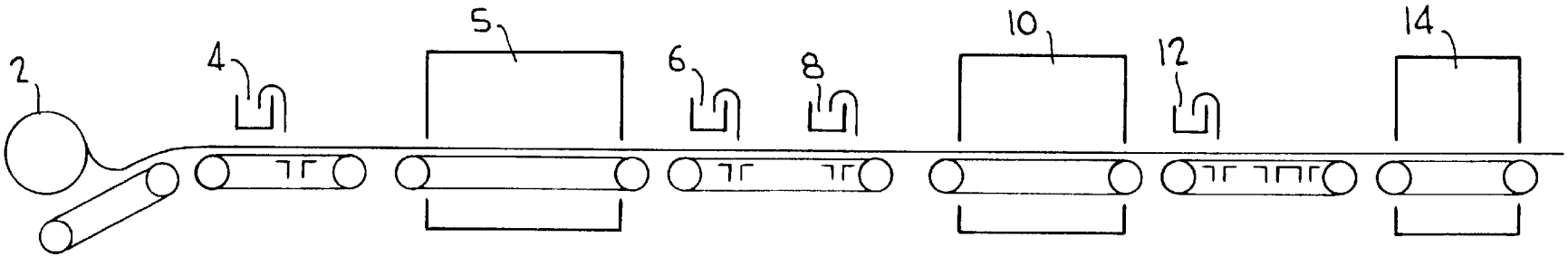

As shown in the Figure, the apparatus may comprise a first station 2 for lapping crude fibers that were previously opened, mechanically cleaned and possibly mixed if of different origins. The lapping means may be any known to the expert, namely mechanical (carding) and/or pneumatic. A particular lap is described in French Patent Application Nos. 93 00982 or 93 03964 wherein it comprises two layers formed of card webs sandwiching a pneumatically-made layer. Depending on application, a lap of 100 to 800 g/m$^2$ is deposited on a conveyor wire which moves it at a specified constant a speed, for example, of 30 m/min, to an impregnation station 4. Station 4 may evince the design disclosed in French Patent Application No. 90 04647 though any other impregnation means also is covered by the scope of the present invention.

The lap loaded with boiling-off liquor (soda and wetting agent) is moved to an evaporator 5 heated to a temperature close to 100° C. where it dwells for a required reaction time while remaining continuous thanks to an appropriate storage device. This reaction depends on the liquor and on the load factor. Next, the lap is rinsed and the boiling-off liquid is extracted at the following station 6.

If the fibers are to be bleached, the hydrophilic boiled-off lap will be impregnated at 8 with a bleaching solution, for example, containing oxygenated water and, then, the lap is again moved into an evaporator 10 heated to a temperature near 100° C. wherein it will dwell long enough for effective bleaching.

The lap is then rinsed and neutralized at 12 to eliminate any reagent residues. The liquids are forced out and the lap is dried in a preferably air-crossed oven 14. Where required, the fibers may be oiled in an ensuing stage or prior to drying by any means known to the expert. The lap made by this process may be used directly in making absorbent cotton or in any other application of cotton in contact with the skin.

In the invention, the rinsing stage prior to drying advantageously is implemented using jets of liquid, in general water, for example, those jets used in the manufacture of non-wovens by hydraulically needling the fibers and which are well known in the field under the name of "jetlace". Illustratively, apparatus made by the firm PERFOJET may be used.

Figure 1A:
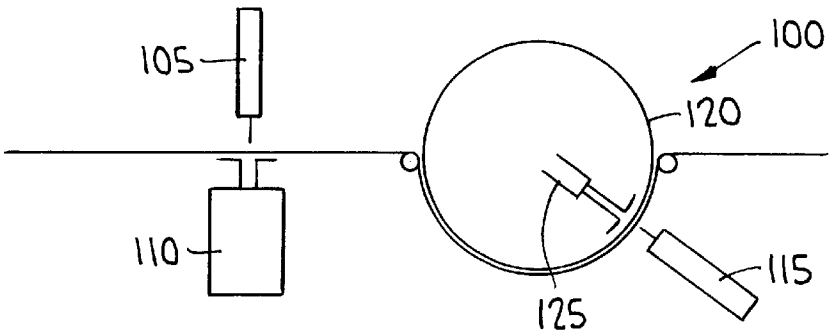

Illustratively, the water-jet rinsing station 100 shown in FIG. 1*a* comprises a needle injector 105 perpendicular to the lap and applying highly pressurized water jets to the lap surface. The diameters of the water jets are small, namely 120 $\mu$m, and spaced by 0.6 mm and arranged in two parallel rows a slight distance from each other. The liquid crosses the lap and the permeable support wire. It is sucked in a parallel direction to the line of jets through a transverse slot communicating with a suction box 110 into this box. In the example shown, the apparatus comprises a second injector 115 treating the opposite side of the lap. This lap is applied to a metal cylinder 120 driven in rotation about an axis perpendicular to the direction of advance of the lap. The cylinder is porous and, illustratively, is covered by a fine metal mesh. The needle injector 115 is situated along a generatrix of the cylinder. The injectors 105 and 115 are supplied from a high-pressure pump not shown.

A suction box 125 is located inside the cylinder and recovers the water from the injector 115. The lap is made to pass around the cylinder so it will be perpendicular to the rinsing jets and then moves onto the conveyor again. The lap is moved to a high-vacuum slot to force out the liquids before being dried in a crossed-air oven, for example, as in the prior apparatus. Lastly, the lap is moved again, for example, to be cut and assembled.

Tests were run on a cotton lap of 250 g/m$^2$ pneumatically made of a central web and sandwiched by two isotropic card webs. This lap was previously bleached and dried using a method of the prior art.

The lap thickness is 4.5 mm when under a load of 5 g/cm$^2$. It still contains small quantities of surfactants which are detected by the methods of the French Pharmacopeia, 10th ed., namely the height of the formed foam and the proportion of water-soluble substances. As regards the tested lap, the test values respectively were 1 mm and 0.3%.

Effect of energy on product thickness at end of process

Figure 2:
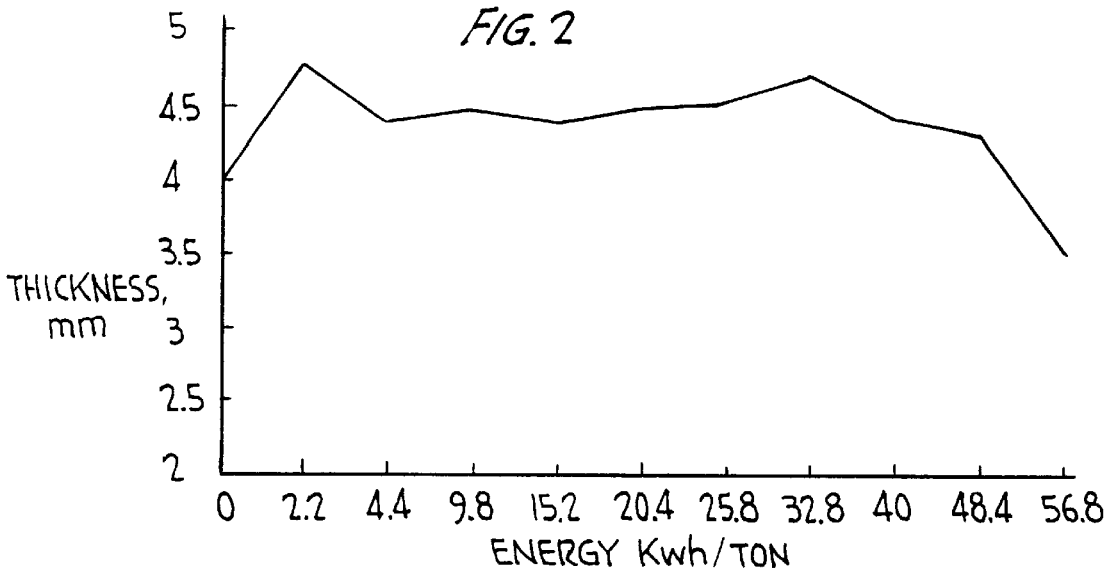
FIG. 2 is a plot of the effect of energy level, per ton of treated product applied to the lap by the water jets, on its thickness in mm.

After the lap was made to pass at a speed of 30 m/min under the water jets of which the supply pressure to the needle injector was varied within 0 to 50 bars corresponding to energies of 0 to 57 kwh/ton and to water flows of 8.9 to 42 m$^3$/ton, the lap thickness was measured at a load of 5 g/cm$^2$ and the test results plotted as in FIG. 2. The lap thickness remains substantially constant as far as an energy of approximately 40 kwh/ton, whereafter it drops.

Treatment efficacy

Figure 3:
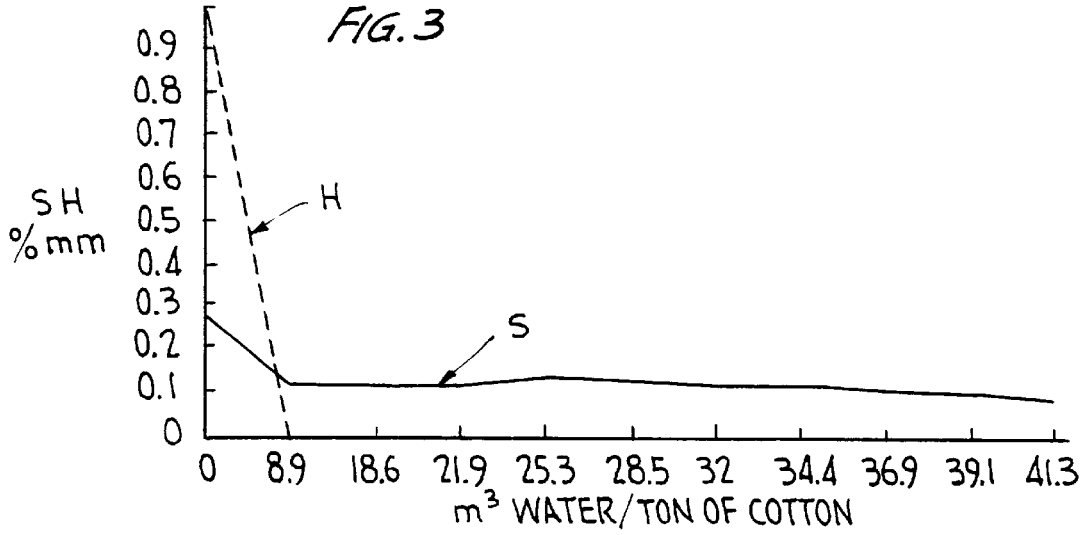
FIG. 3 is a plot showing the effect of the flow per ton of treated product on the foam height H in mm and the percentage proportion S of soluble materials relative to the fibers.

The lap is made to pass at a speed adjusted to 30 m/min under the water jets. The supply pressure to the needle injector is varied between 0 and 50 bars corresponding to energies of 0 to 57 kwh/ton and to water flows of 8.9 to 42 m$^3$/ton. The presence of residual products was detected in the Codex manner by measuring foam height and proportion of water-soluble substances, which are shown in the plot of FIG. 3 where the abscissa is the water flow per ton of treated product and the ordinate shows, on one hand the foam height in mm and on the other hand the percent proportion of water soluble substances relative to cotton.

The foam height will be zero mm starting at 8.9 m$^3$/ton, i.e., 2.2 kwh/ton, and the proportion of water-soluble substances is simultaneously lowered to 0.1%.

Effect of energy on strength in the direction of advance

The 250 g/m$^2$ lap is moved at a specified speed of advance of 30 m/min under the jets of water with one injector on each side. The supply pressure to the needle injector is varied between 0 and 50 bars corresponding to energies of 0 to 57 kwh/ton and to water flows of 8.9 to 42 m$^3$/ton. The lap's strength in Newtons was tested in the direction of advance at increasing energy values by pulling on test pieces cut out of the lap until they ruptured using an INSTRON apparatus. The test was carried out as follows:

jaw separation speed of the INSTRON apparatus: 100 mm/min;

width of test piece: 50 mm; and length of test piece: 100 mm.

Figure 4:
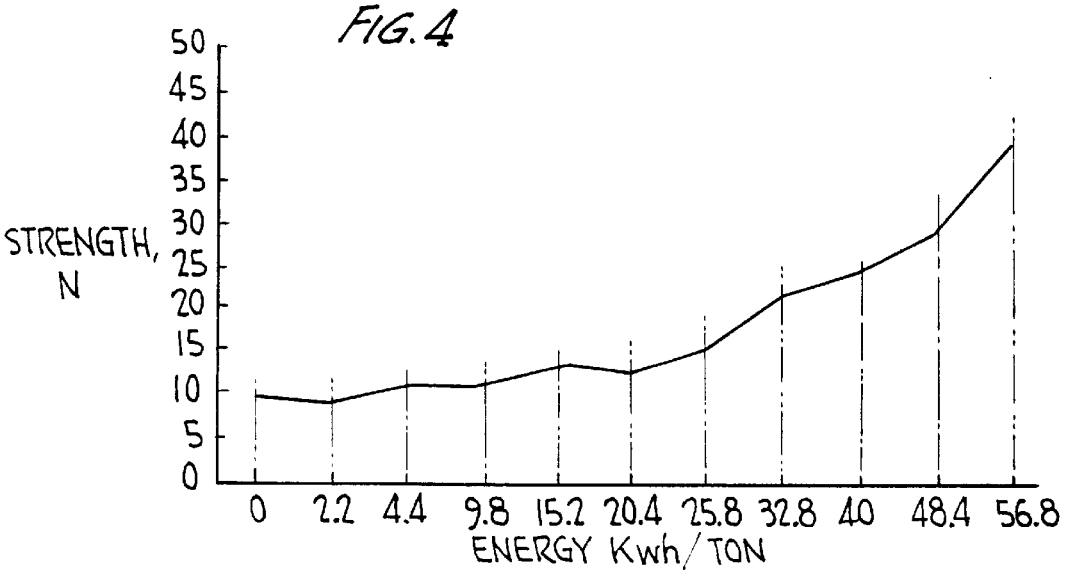
FIGS. 4 and 5 are plots showing the effect of the level of energy, per ton of treated product applied by the water jets to the lap, on the rupture strengths in the direction of advance and in the transverse direction.

The test values are plotted as ordinates in FIG. 4 and the energy in kwh/ton of treated product is shown as the abscissa.

The strength increases little in the direction of advance up to 25 kwh/ton and rises thereafter.

Effect of energy on the transverse strength

Figure 5:
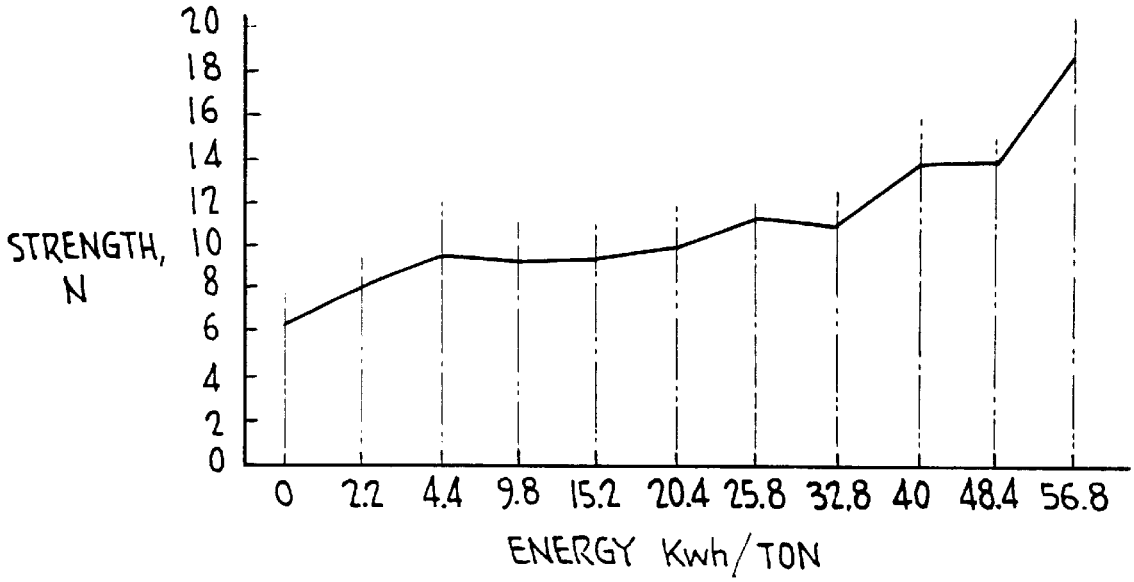

The transverse strength in Newtons was measured in the manner above and the test values were plotted in FIG. 5.

The transverse strength increases substantially up to 4.4 kwh/ton and then slightly to 25.6 kwh/ton, whereupon it rises again substantially until 57 kwh/ton.

Effect of energy on the delamination strength of the surface web

The lap is stratified and of the type manufactured in the manner of the disclosure of the above cited French Application No. 93 00968. The lap was water-jet treated as above. The force required to separate one of the surface webs from the central layer is measured. The test is carried out on an INSTRON apparatus. The test methods are the same as above.

Figure 6:
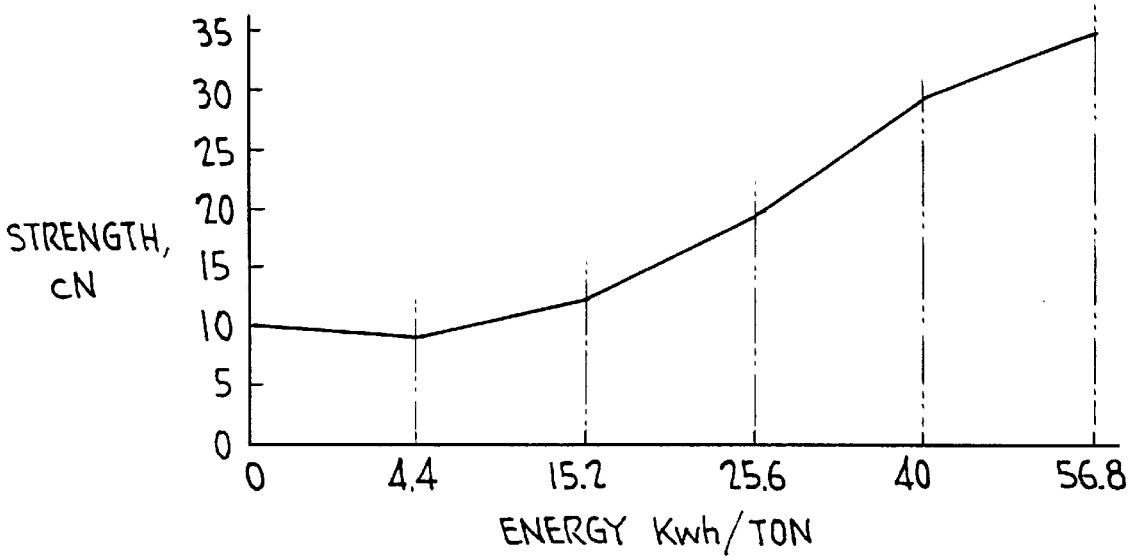
FIG. 6 is a plot showing the effect of the level of energy, per ton of treated product, on delamination strength in cN of a stratified fiber lap disclosed in French Patent Application No. 93 03964.

Delamination strength values in cN are plotted as ordinates, the abscissa showing the various energy values of the jets treating the lap (FIG. 6).

Picking strength increases markedly beyond 15 kwh/ton.

Accordingly, these tests show that the invention achieves effective rinsing without thereby altering the lap structure and while retaining the improved strength. As regards the manufacture of packaged absorbent cotton, an energy range between 2 and 10 kwh/ton and a flow preferably between 8 and 22 $m^3$/ton of treated product are selected. As regards the manufacture of products such as makeup-removal pads which must offer a given strength, the mechanical lap strength is improved by preferably selecting a range from 10 to 40 kwh/ton and the flow being between 8 and 37 $m^3$/ton of treated product.

The test values are listed in the Table below.

We claim:

1. A process for treating natural cellulose fibers comprising (1) depositing the fibers on a continuously moving wire to form a lap having a specific surface weight of between 100 and 800 g/$m^2$, (2) impregnating the lap with a treating solution, and (3) rinsing the lap following impregnation of the lap using an aqueous liquid in the form of jets, wherein said jets are directed at a first side of the lap perpendicularly to a direction of advance of said lap and at an energy of 2 to 60 kwh/ton of treated product.

2. Process as claimed in claim 1 wherein the energy is between 2 and 10 kwh/ton of treated product.

3. Process as claimed in claim 2 wherein flow of said aqueous liquid is between 8 and 22 $m^3$/ton of treated product.

4. Process as claimed in claim 1 wherein said energy is between 2 and 40 kwh/ton of treated product.

5. Process as claimed in claim 1 wherein said energy is between 10 and 40 kwh/ton of treated product.

6. Process as claimed in claim 4 wherein flow of said aqueous liquid is between 8 and 37 $m^3$/ton of treated product.

7. Process as claimed in any one of claims 1, 2, 3, 4, 5 or 6 wherein the jets also are applied to a second side of the lap which is opposite of said first side.

8. Process as claimed in any one of claims 1, 2, 3, 4, 5 or 6 wherein up to 30% of synthetic fibers are incorporated into said lap prior to impregnating the lap.

9. Process as claimed in claim 7 wherein up to 30% of synthetic fibers are incorporated into said lap prior to impregnating the lap.

* * * * *

LAP = 250 g/$m^2$; SPEED = 30 m/min; 2 injectors, one on each side

| ΔP per injector (bars) | ENERGY (kwh/-ton) | WATER flow $m^3$/ton | Min. SA (N) | Max. SA (N) | Mean SA (N) | Min. ST (N) | Max. ST (N) | Mean ST (N) | T/5 g (mm) | T/20 g (mm) | Spec. Surface Weight (g/$m^2$) | Foam H, (mm) | Water-soluble sub-stance S, percent |
|---|---|---|---|---|---|---|---|---|---|---|---|---|---|
| | 0 | 0 | 6.8 | 12.2 | 9.4 | 6 | 7.7 | 6.4 | 4 | 2.4 | 248 | 1 | 0.28 |
| 5 | 2.2 | 8.9 | 7.5 | 10.4 | 9.1 | 6.8 | 8.9 | 8.1 | 4.8 | 3.1 | 272 | 0 | 0.11 |
| 10 | 4.4 | 18.6 | 8.1 | 13.9 | 10.9 | 7.9 | 10.9 | 9.5 | 4.4 | 4 | 274 | 0 | 0.11 |
| 15 | 9.8 | 21.9 | | | 11 | | | 9.2 | 4.5 | | | 0 | 0.12 |
| 20 | 15.2 | 25.3 | 10.5 | 15.1 | 13 | 8.6 | 10 | 9.3 | 4.4 | 3.9 | 277 | 0 | 0.14 |
| 25 | 20.4 | 28.6 | 10.8 | 13.8 | 12.3 | 9.5 | 10.3 | 9.9 | 4.6 | 3.7 | 269 | 0 | 0.13 |
| 30 | 25.6 | 32 | 13.2 | 17.6 | 15.2 | 9.8 | 13.8 | 11.2 | 4.5 | 3.6 | 264 | 0 | 0.12 |
| 35 | 32.8 | 34.4 | 15.2 | 24.9 | 21.8 | 9.1 | 12.2 | 10.9 | 4.7 | 3.9 | 271 | 0 | 0.12 |
| 40 | 40 | 36.9 | 22.1 | 28.6 | 24.6 | 10 | 16.4 | 13.8 | 4.4 | 3.3 | 270 | 0 | 0.11 |
| 45 | 43.4 | 39.1 | 27 | 35.9 | 29.3 | 12.4 | 15.9 | 14 | 4.3 | 3.7 | 256 | 0 | 0.11 |
| 50 | 56.8 | 41.3 | 32.6 | 48.4 | 40.1 | 15.7 | 19.9 | 18.7 | 3.5 | 3.1 | 252 | 0 | 0.09 |

SA = strength in direction of ADVANCE
ST = strength in TRANSVERSE direction
T = thickness (when loaded at 5 g/$cm^2$ or 20 g/$cm^2$).